US012110080B2

(12) United States Patent
Marsh

(10) Patent No.: US 12,110,080 B2
(45) Date of Patent: Oct. 8, 2024

(54) DRAINAGE VALVE SYSTEM FOR RECREATIONAL WATERCRAFTS

(71) Applicant: Swell Watercraft, LLC, Bellingham, WA (US)

(72) Inventor: James Jeffrey Marsh, Bellingham, WA (US)

(73) Assignee: SWELL WATERCRAFT, LLC, Bellingham, WA (US)

( * ) Notice: Subject to any disclaimer, the term of this patent is extended or adjusted under 35 U.S.C. 154(b) by 800 days.

(21) Appl. No.: 17/335,955

(22) Filed: Jun. 1, 2021

(65) Prior Publication Data

US 2022/0380003 A1 Dec. 1, 2022

(51) Int. Cl.
*B63B 34/21* (2020.01)
*B63B 13/00* (2006.01)
*B63B 34/26* (2020.01)

(52) U.S. Cl.
CPC ..... *B63B 34/21* (2020.02); *B63B 13/00* (2013.01); *B63B 34/26* (2020.02)

(58) Field of Classification Search
CPC ..... B63B 34/21; B63B 34/26; B63B 13/00
See application file for complete search history.

(56) References Cited

U.S. PATENT DOCUMENTS 1,572,074 A * 2/1926 Nelson ..... B63B 13/00 114/182
2,649,277 A * 8/1953 Blackford ..... F16K 15/028 137/515
3,065,725 A * 11/1962 Karoly ..... B63B 13/00 114/185
3,572,280 A * 3/1971 Monson ..... B63B 13/00 114/184
6,754,915 B2 * 6/2004 Mistarz ..... E04H 4/1218 4/507
6,973,891 B1 * 12/2005 Warner ..... B63B 13/00 114/197
8,763,548 B2 * 7/2014 Swetish ..... B63B 13/00 114/182
2016/0059934 A1 * 3/2016 Wilhelm ..... B63B 1/32 114/271
2022/0340236 A1 * 10/2022 Steed ..... B63H 5/00
2022/0380003 A1 * 12/2022 Marsh ..... B63B 34/21
2023/0144630 A1 * 5/2023 Fenn ..... B63B 34/05 114/255

OTHER PUBLICATIONS

"Medium Scupper Valve—2 Pack," Ocean Kayak Website, Available Online at https://oceankayak.johnsonoutdoors.com/accessories/fishing/medium-scupper-valve-2-pack, Retrieved on Sep. 1, 2021, 11 pages.

* cited by examiner

*Primary Examiner* — S. Joseph Morano
*Assistant Examiner* — Jovon E Hayes
(74) *Attorney, Agent, or Firm* — McCoy Russell LLP

(57) ABSTRACT

Methods and systems are provided for draining water from the interior of a watercraft via a drainage valve system. In one example the drainage valve system has an outer frame housing an inner ball valve. The drainage valve system is adapted to be slidable between a first and a second position.

20 Claims, 9 Drawing Sheets

DRAINAGE VALVE SYSTEM FOR RECREATIONAL WATERCRAFTS

FIELD

The present description relates generally to a drainage system for recreational watercrafts.

BACKGROUND AND SUMMARY

Manual propulsion of recreational watercrafts has become a popular pastime for outdoors enthusiasts. Kayaking, in particular, is especially appealing due to modern advances in manufacturing that have enabled production of lightweight boats that are easily transportable. A variety of kayak models are commercially available with attributes developed for specific water conditions and experience levels as well as physical capabilities of the user. One type of kayak, the sit-on-top kayak, is especially attractive for the novice kayaker due to an ease of entry and exit from the watercraft.

The sit-on-top kayak is configured with a molded depression to accommodate a seated position of the user. Unlike traditional kayaks where the user sits within a cavity of the body of the kayak below the water level where the seat well opening is covered with a skirt, the sit-on-top kayak has an open deck with a seating depression. In the event of the sit-on-top kayak tipping over, the user is not trapped within the seat well. Furthermore, sit-on-top kayaks are often more stable and more durable, due to formation from plastic or other rugged and moldable materials, than traditional kayaks and may offer a lower cost option.

The open deck of the sit-on-top kayaks, however, may allow for water to flow to and collect in the seating depression. In turbulent conditions, water accumulation within the seating depression may lead to sinking of the kayak and/or difficulty paddling the kayak to shore. One example approach to address water accumulation in the sit-on-top kayaks includes installing drains, also referred to as scuppers, in a hull of the kayak. The scuppers may extend from a top surface of the kayak hull through a bottom of the hull, forming an outlet located either above or below the waterline, thereby allowing water to flow out of the seating area. In some examples, the scuppers may be plugged to inhibit water from entering the kayak through the scupper. However, plugging the scuppers also inhibits a draining capacity of the scupper.

Other attempts to address the issue of drainage while simultaneously inhibiting flooding of the kayak seating area include the use of a scupper plug with a one-way valve, as shown by Swetish et al. in U.S. Pat. No. 8,763,548. Therein, a scupper drain has a valve structure that allows water to flow through the scupper plug in a first direction but sealingly engages the valve structure to inhibit flow in a second direction opposite the first. The scupper drain is positioned in a scupper to channel water out of the seating area of a sit-on-top kayak while impeding entry of water through the scupper drain into the seating area.

However, the inventors herein have recognized potential issues with such systems. The drainage of water through the valve, is often slow relative to the accumulation of water within the seating depression and the constant engagement of the valve with flowing water may increase the likelihood of degradation of the valve, leading to leakage. Furthermore, when the kayak is heavily loaded, resulting in constant submergence of the scupper drain outlets below a water line, a drainage efficiency of the scupper drain may be greatly reduced.

In one example, the issues described above may be addressed by a drainage valve system including an outer frame configured to slide upwards vertically to retract within a scupper of the watercraft in a first position, the first position a closed position blocking flow of water through the scupper, slide downwards vertically to protrude from the scupper in a second position, the second position a position open to flow of the water through the scupper, and an inner ball valve that is a buoyant sphere adapted to fit moveably within a portion of the outer frame. In this way, the scupper drainage valve system may actively drain water from the interior of the sit-on-top kayak and inhibit the re-entry of water through the scupper by generating suction created by the valve structure moving through water to actively suck water out of the kayak interior even though the final outlet of the valve is below the waterline of the kayak.

In an aspect of this disclosure, a method may be provided, including moving the watercraft through water with a drainage valve system in a first, extended position, water flowing past at least part of an extended exit port of the drainage valve system creating suction to draw water through the drainage valve system, and adjusting the drainage valve system into a second, less extended position in which the drainage valve system is fully closed between the exit port and the interior of the watercraft.

In another aspect of this disclosure, a watercraft, such as a kayak includes a wall with a movable valve element positioned therein, the valve having an exit port forming channels that, when extended from the wall, create suction with the watercraft moving through the water, the valve positionable in a less-extended closed position.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 1A-2C are shown approximately to scale, although other relative dimensions may be used.

DETAILED DESCRIPTION

Figure 1A:
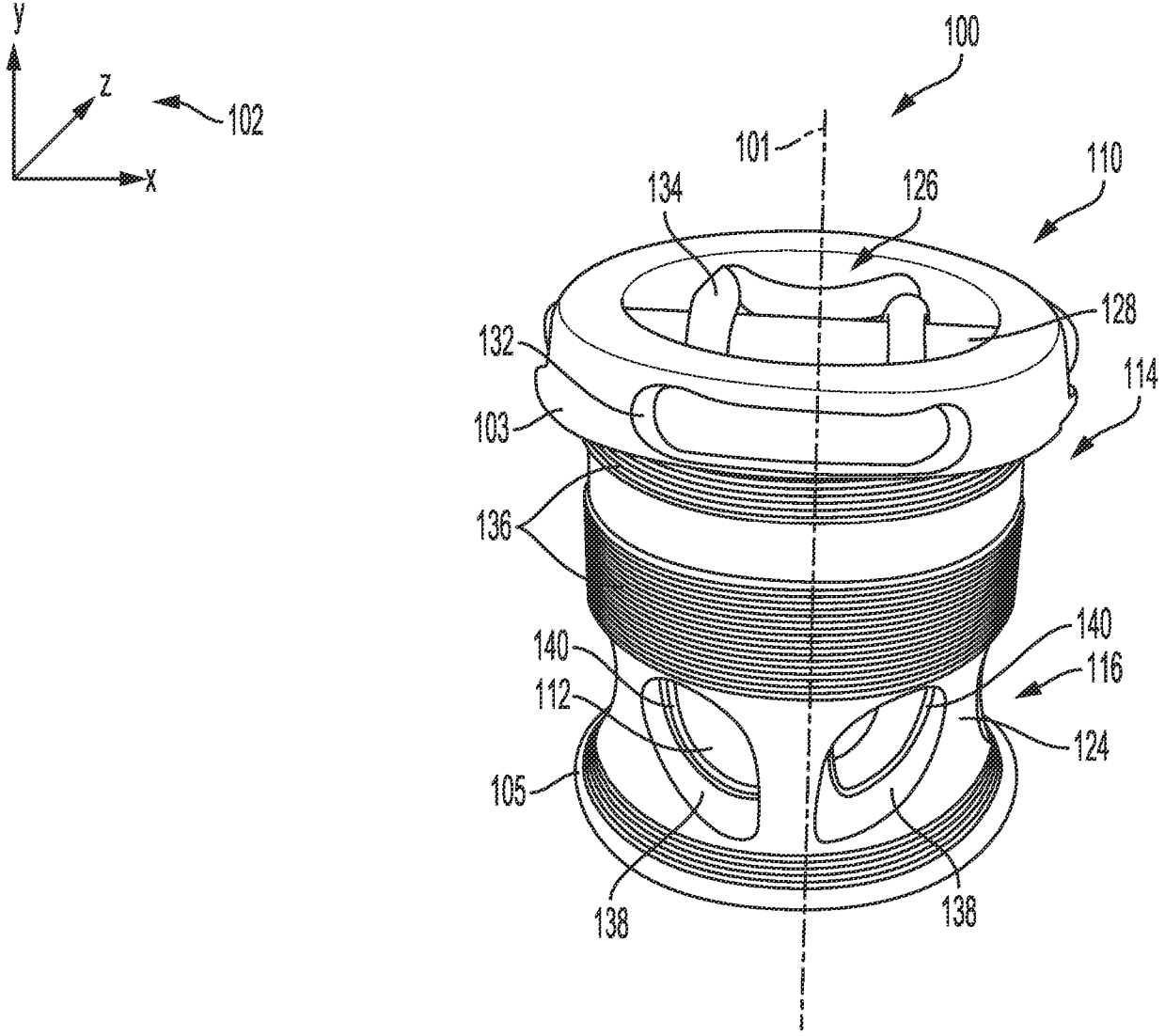
FIG. 1A shows a perspective side view of a drainage valve system.
Figure 1B:
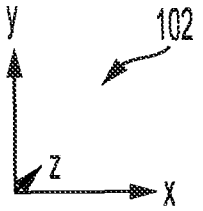
FIG. 1B shows a side view of the drainage valve system.
Figure 1B:
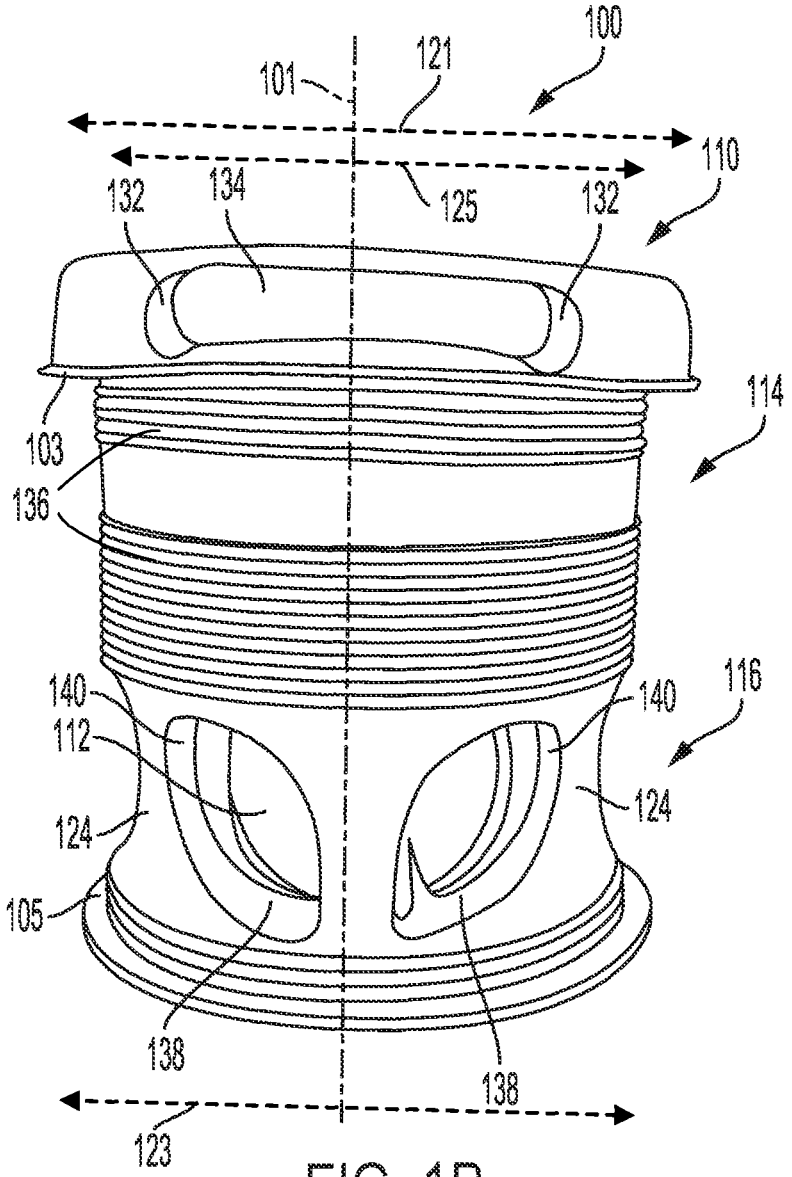

The following description relates to systems and methods for draining water from a seating depression in a sit-on-top kayak, also referred to as a kayak, or other type of recreational watercraft. An example of a drainage valve system is shown in FIGS. 1A-1D. Perspective, side, top and bottom views of the drainage valve system are shown in FIGS. 1A-1D respectively, illustrating an arrangement of apertures of the drainage valve system and a geometry of an outer frame of the drainage valve system. The drainage valve system may have a hollow outer frame enclosing a set of inner chambers. An inner ball valve controlling flow through the drainage valve system may be positioned within one of the set of inner chambers and is also depicted in FIGS. 1A-1C. A cross-section of the drainage valve system is shown in FIG. 1E illustrating an arrangement of the set of inner chambers within the outer frame as well as dimensions of the set of inner chambers. An example of a recreational watercraft is depicted in FIG. 2A from a top-down view, for which the drainage valve system may be configured to mitigate water accumulation in a seating area of the watercraft. A profile view of the recreational watercraft indicating a water surface level relative to the watercraft is shown in FIG. 2B. The drainage valve system of the water craft may be in a first position, depicted in FIG. 2B, where most of the drainage valve system may be above the water line, in a disengaged configuration. In FIG. 2C, a similar profile view of the recreational watercraft is shown with the drainage valve system in a second, extended position with the drainage valve system arranged mostly below the water line. The second position may be an engaged configuration enabling active drainage of water from the seating area out of the recreational watercraft through the drainage valve system. A more detailed profile view of the drainage valve system in the second position is provided in FIG. 3, indicating a pressure differential generated by movement of the watercraft, flow of water through the drainage valve system, and a role of the inner ball valve in enabling one-way flow of water from an interior to an exterior of the watercraft. A similar profile view of an alternate arrangement of the drainage valve system is shown in FIG. 4 where a scupper of the watercraft is oriented at a different angle relative to a bottom surface of the watercraft, resulting in an angled positioning of the drainage system.

Turning now to FIGS. 1A-1E, a drainage valve system 100 is shown. The drainage valve system 100 may have an overall cylindrical geometry with a hollowed interior to allow water to flow through the interior of the drainage valve system 100 along a central axis 101 of the drainage valve system 100. The drainage valve system 100 may be used to drain water from a seating area or an interior of a watercraft in a first direction, during forward movement of the watercraft, and inhibit flow in a second direction, opposite of the first direction. By positioning the drainage valve system 100 in a scupper of the watercraft, the drainage valve system 100 may control flow through the scupper. The scupper may be an opening in a hull of the watercraft that fluidly couples air or water in the interior or seating area of the watercraft to air or water surrounding the hull of the watercraft. The scupper may be disposed in a region of the watercraft that is consistently submerged below a water surface level when the watercraft is in use. For example, in a sit-on-top kayak, one or more scuppers may be located in foot beds of a molded seating depression where a user's feet may be positioned. The foot beds may be a lowest area of the seating depression, e.g., closest to or below the water surface level. An arrangement of scuppers in which the drainage valve system may be installed is shown and described further below with respect to FIG. 2A. It will be appreciated that a watercraft may be adapted with a plurality of scuppers in various regions of the watercraft and each scupper of the plurality of scuppers may be adapted with the drainage valve system 100.

The drainage valve system 100 may include an outer frame 110 and an inner ball valve 112, the inner ball valve 112 shown in FIGS. 1A-1C. A perspective side view of the drainage valve system 100 is depicted in FIG. 1A, a side view in FIG. 1B, a top view in FIG. 1C, a bottom view in FIG. 1D and a cross-section in FIG. 1E. The cross-section of FIG. 1E is taken along line 144 shown in FIG. 1C. FIGS. 1A-1E will be described collectively and common components are similarly numbered. A reference set of axes 102 is provided for comparison between the views shown and indicates a y-axis, an x-axis, and a z-axis. In some examples, the y-axis may be parallel with a vertical direction, the x-axis with a horizontal direction, and the z-axis with a transverse direction perpendicular to the x- and y-axes. In FIGS. 1A-1E, the drainage valve system 100 is shown with the central axis 101 aligned parallel with the y-axis. However, alternate orientations of the reference axes 103 relative to the drainage valve system 100 are possible.

The outer frame 110 may be a hollow rigid structure and a generally cylindrical outer shape with a top lip 103 and a bottom lip 105. Both the top lip 103 and bottom lip 105 extend in an outward direction, as measured in a direction perpendicular to and away from the central axis 101. An outer diameter 121, as measured in a direction perpendicular to the central axis 101, of the outer frame 110 at the top lip 103 may be similar to or slightly wider than an outer diameter 123 of the outer frame 110 at the bottom lip 105. The outer diameters 121 and 123 are indicated in FIG. 1B. The outer diameters 121 and 123 of the outer frame 110 at both the top lip 103 and bottom lip 105 are wider than a diameter 125 of the body of the outer frame 110 (shown in FIG. 1B).

The outer frame 110 may comprise a first outer portion 114 arranged above and continuously coupled to a second outer portion 116. In other words, a continuous surface of the outer frame 110 forms both the first outer portion 114 and the second outer portion 116 and is uninterrupted at a region where the first outer portion 114 and the second outer portion 116 merge. The first outer portion 114 may be mirror-symmetric about the dissecting line 144 shown in FIG. 1C and also mirror-symmetric about a line 145, also shown in FIG. 1C, similarly dissecting the drainage valve system 100 but arranged perpendicular to the dissecting line 144. The first outer portion 114 may be cylindrical and hollow, circumferentially surrounding, e.g., enclosing, a first inner chamber 118 as well as a portion of a second inner chamber 120 that is positioned substantially below the first inner chamber 118, the first inner chamber 118 and second inner chamber 120 shown in FIG. 1E. A remaining portion of the second inner chamber 120 that is not enclosed by the first outer portion 114, is circumferentially surrounded and enclosed by the second outer portion 116.

The second outer portion 116 may also be cylindrical and hollow and be a stem of the drainage valve system 100, with outer walls 124 that curve inwards towards the central axis 101. The second outer portion 116 is mirror-symmetric about the dissecting line 144 shown in FIG. 1C but not mirror-symmetric about the line 145, also shown in FIG. 1C, due to a positioning of a set of two apertures 138 arranged in the second outer portion 116, as described further below.

As shown in FIG. 1E, the first inner chamber 118 may have a diameter 107, as measured in a direction perpendicular to the central axis 101, that may be greater than a height 109 of the first inner chamber 118, the height 109 measured along the central axis 101. The diameter 107 of the first inner chamber 118 may taper, becoming narrower downwards along the y-axis towards a bottom region of the first inner chamber 118. The first inner chamber 118 may be fluidly coupled to the second inner chamber 120 via an inner opening 122, as seen in FIG. 1E. Inner opening 122 may act as a constriction between the first inner chamber 118 and the second inner chamber 120 by having a narrower diameter 127, measured in a direction perpendicular to the central axis 101 (e.g., a radial direction), than either the first inner chamber 118 or second inner chamber 120.

The inner ball valve 112 of drainage valve system 100, which may be a hollow air-filled sphere formed from a lightweight plastic or some other material that allows the inner ball valve 112 to be buoyant in water, is enclosed within the second inner chamber 120. A size of the ball valve 112 may be adapted to dimensions of the second inner chamber 120. As illustrated in FIG. 1E, a height 111 of the second inner chamber 120, measured along y-axis, may be greater than a diameter 113, measured along the x-axis, of the second inner chamber 120. The height 111 of second inner chamber 120 may be greater than the height 109 of the first inner chamber 118 and the diameter 113 of the second inner chamber 120 may be less than the diameter 107 of the first inner chamber 118.

The inner ball valve 112 may have a diameter that is slightly smaller than the diameter 113 of second inner chamber 120 as well as smaller than the height 111 of the second inner chamber 120. However, the diameter of the inner ball valve 112 is wider than the diameter 127 at the inner opening 122 of the drainage valve system 100. Thus the inner ball valve 112 may be relatively constrained in movement along the x-z plane but may be able to travel a greater distance in a vertical direction, along the central axis 101. The vertical movement of the inner ball valve 112 within the second inner chamber 120 may be bound by contact between the inner ball valve 112 and inner opening 122 of the drainage valve system 100 and between the inner ball valve 112 and the bottom surface 148. The constriction formed by inner opening 122 between the first inner chamber 118 and second inner chamber 120 blocks the inner ball valve 112 from rising up into the first inner chamber 118.

In one example of the drainage valve system 100, the outer frame 110 may be formed of a rigid material such as a molded plastic. In another example, the outer frame 110 may be formed from a metal or metallic alloy. In other examples, the outer frame 110 may be formed from a hard rubber, or nylon, or another rigid material resistant to corrosion or oxidation in water. As such, various materials to form the outer frame 110 of the drainage valve system 100 have been contemplated without affecting a usage of the drainage valve system 100.

A top opening 126, shown in FIGS. 1A and 1C, in the first outer portion 114 of the outer frame 110 of the drainage valve system 100 may have an annular geometry when viewed from above (as in FIG. 1C). The top opening 126 may be an inlet port of the drainage valve system 100 with water accumulated within the interior or seating area of the watercraft flowing into the top opening 126. While water may enter the drainage valve system 100 through the top opening 126 and flow vertically, with respect to the y-axis, through the first inner chamber 118, the flow becomes non-linear upon entering the second inner chamber 120. The path of flow may curve around the inner ball valve 112 and be deflected to flow perpendicular to the central axis 101 when the water contacts a bottom surface 148 of the drainage valve system 100, the bottom surface 148 described further below.

A bar 128, also shown in FIGS. 1A and 1C, may be disposed across the top opening 126 parallel with the x-axis at an upper region, with respect to the y-axis, of the first inner chamber 118. Ends of the bar 128 may be adapted to fit into grooves, similar to grooves 130 shown in FIG. 1E, disposed in an inner surface of the top opening 126 so that the bar 128 is held securely in place. The bar 128 may be formed from a rigid, durable material resistant to corrosion in water, such as molded plastic or anodized aluminum. The bar 128 may provide a secure handhold for a user to pull the drainage valve upwards within the scupper of the watercraft.

An upper region of the first outer portion 114 may also include apertures 132, as shown in FIGS. 1A-1B and 1E, distributed around a circumference of the first outer portion 114 and above the top lip 103. The apertures 132 may be evenly spaced apart around the circumference of the first outer portion 114, above the top lip 103 and may have diameters, defined along the y-axis, adapted to allow a rope or string 134, as shown in FIGS. 1A-1C, to be fed through the apertures 132. As such, the diameters of the apertures 132 may be narrow in comparison to the diameters 107 and 113 of the first inner chamber 118 and second inner chamber 120, respectively. The apertures 132 may be circular through-holes extending entirely through the surface of the outer frame 110 and the rope 134 may be woven through the apertures 132. The weaving of the rope 134 through each of the apertures 132 results in the rope 134 entirely surrounding the circumference of the first outer portion 114 of the drainage valve system 100, above the top lip 103. Portions of the rope 134 may be in contact with an outer surface of the outer frame 110 while other portions of the rope 134 may be in contact with an inner surface of the outer frame 110, e.g., with walls of the first inner chamber 118 in an upper region of the first inner chamber 110. The rope 134, when wound through the apertures 132 may have a generally circular shape with evenly spaced apart teeth, e.g., similar to a cogwheel, around a circumference of the rope. Ends of the rope 134 may be tied together to form a closed loop.

In some examples, an outer surface of the first outer portion 114 of the outer frame 110 of drainage valve system 100 may include ridges 136, as shown in FIGS. 1A-1C and 1E, extending circumferentially around the outer surface of the first outer portion 114. In other examples, the outer surface of the first outer portion 114 of the outer frame 110 may have more or less ridges 136, or the ridges 136 may be positioned in a different pattern on the outer surface of the first outer portion 114 than shown in FIGS. 1A-1E. In yet another example, the outer surface of the first outer portion 114 of the outer frame 110 may not include any ridges 136. The ridges may provide traction when the outer surface of the first outer portion 114 is gripped by a user's hand, allowing a more secure handhold for maneuvering the drainage valve system 100.

The set of two apertures 138 may be arranged in the second outer portion 116 of the outer frame 110. The set of two apertures 138 may be through-holes in a surface of the second outer portion 116 of the outer frame 110 and may also be exit ports for the drainage valve system 100, allowing flow of water between the second inner chamber 120 and water surrounding the drainage valve system 100 when the drainage valve system 100 is submerged. The set of two apertures 138 may be larger than an aperture of the apertures 132 of the first outer portion 114 and be shaped as tilted ellipses rather than circles, with a set of top ends 140 of the set of two apertures 138 angled outwards and away from the central axis 101. The set of two apertures 138 may be positioned so that one aperture of the set of two apertures is arranged on a first half 142 and the other aperture of the set of two apertures 138 is arranged on a second half 146 of the outer frame 110, the first half 142 and second half 146 indicated in FIG. 1C and the first half 142 shown in FIG. 1E. The first half 142 may be divided from the second half 146 of the outer frame 110 by the dissecting line 144 depicted in FIG. 1C. The dissecting line 144 is perpendicular to the bar 128. The set of two apertures 138 may be aligned relative to one another in a configuration that is parallel to the bar 128. Thus each of the first half 142 and the second half 146 of the outer frame 110, may include one aperture of the set of two apertures 138.

Figure 1D:
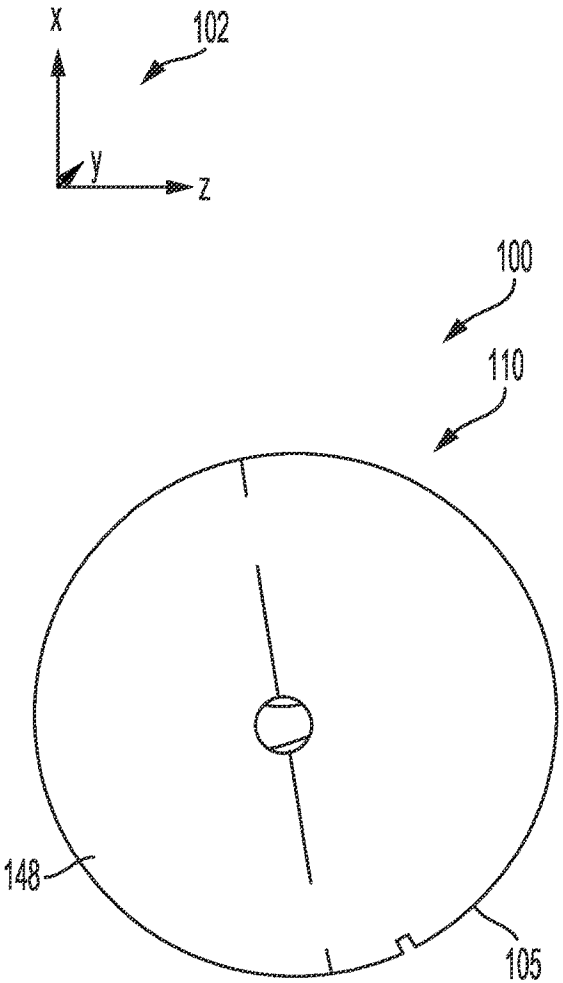
FIG. 1D shows a bottom view of the drainage valve system.
Figure 1C:
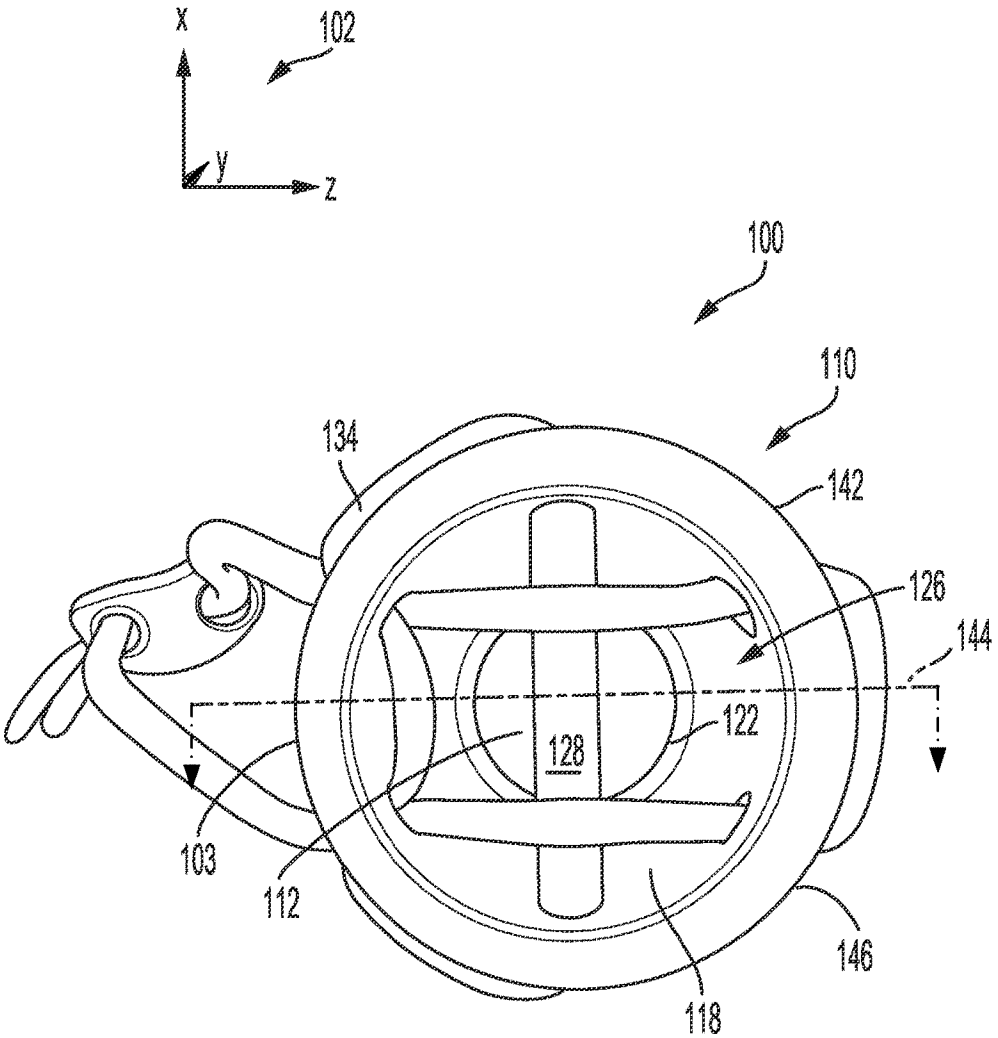
FIG. 1C shows a top view of the drainage valve system.
Figure 1E:
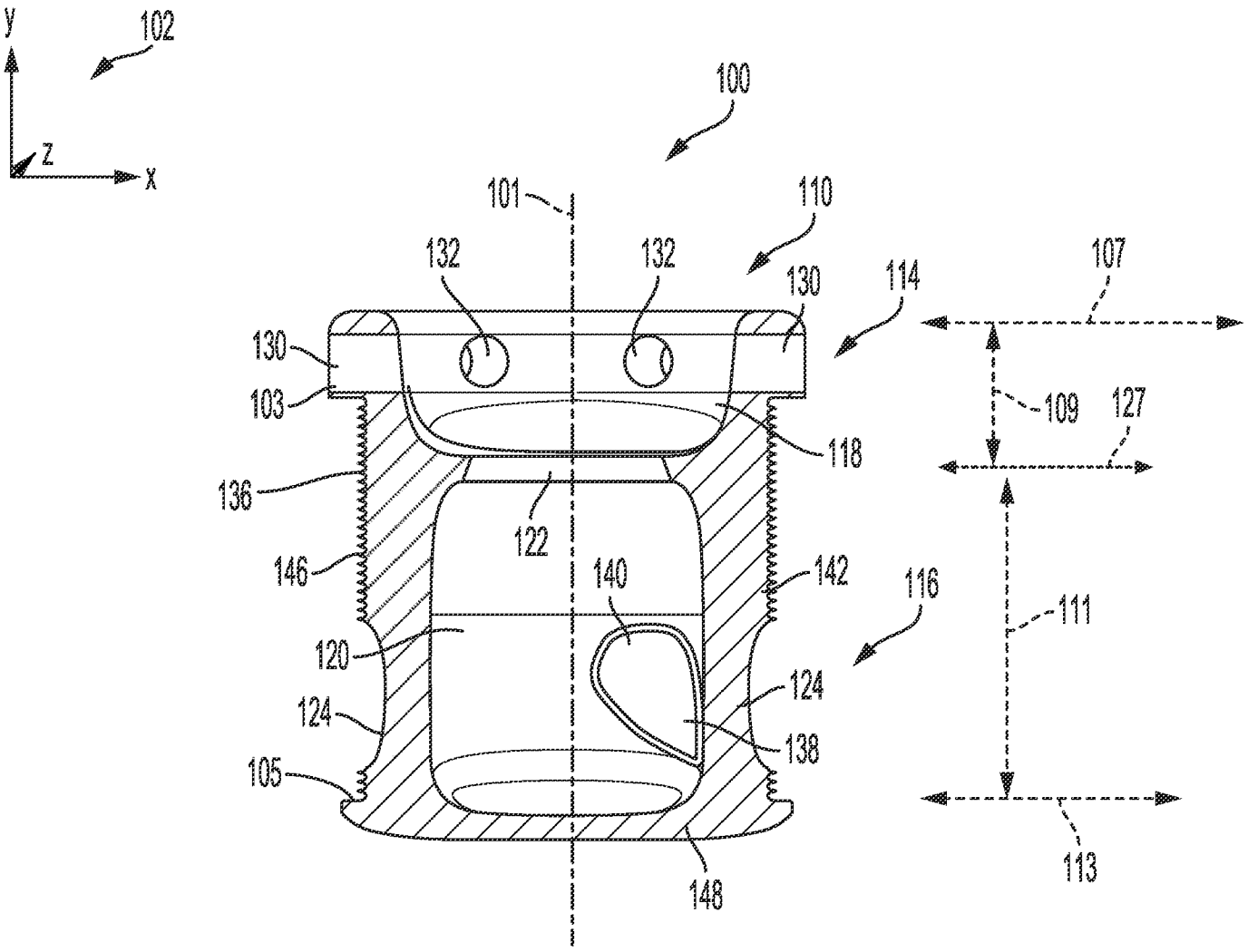
FIG. 1E shows a cross-section of the drainage valve system.
Figure 2A:
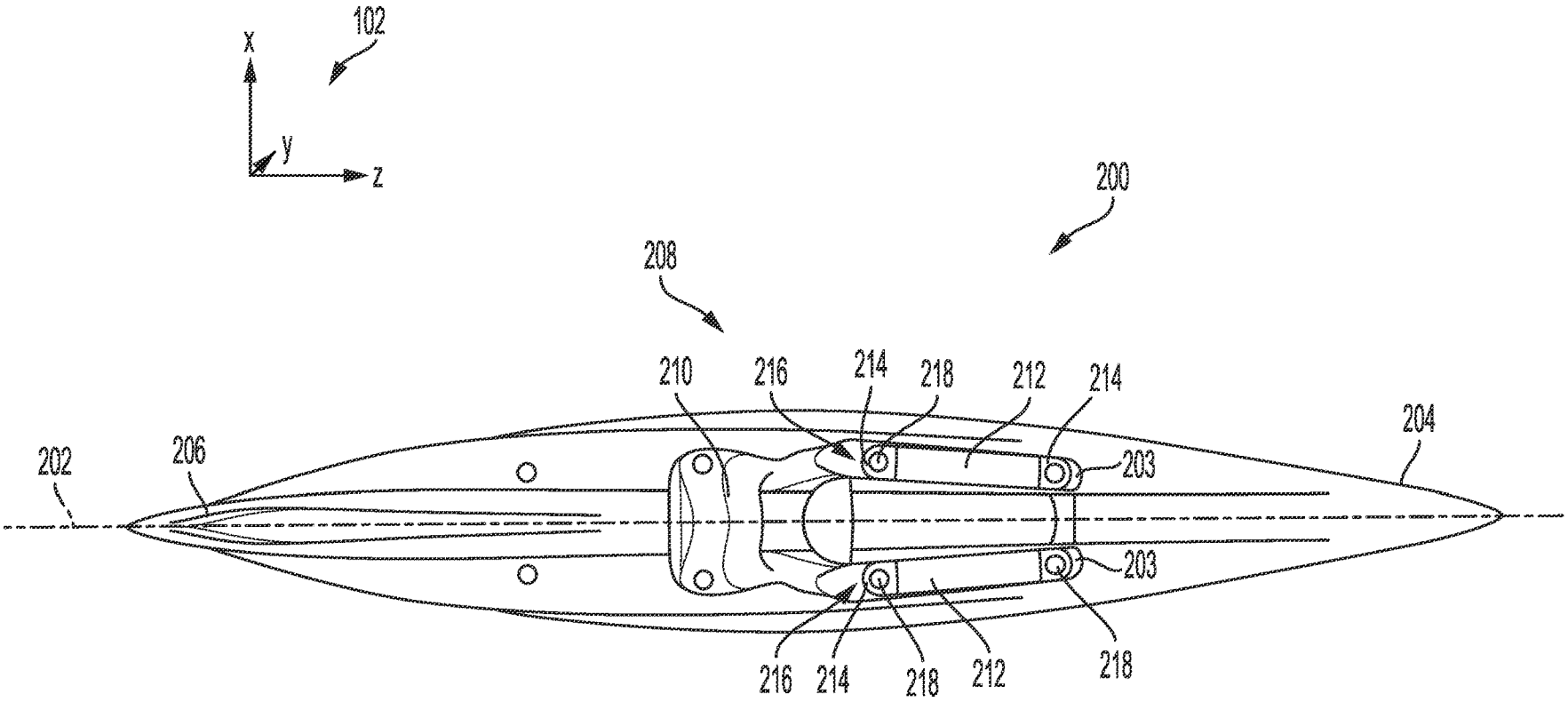
FIG. 2A shows a top view of an example of a sit-on-top kayak in which the drainage valve system may be used.
Figure 2B:
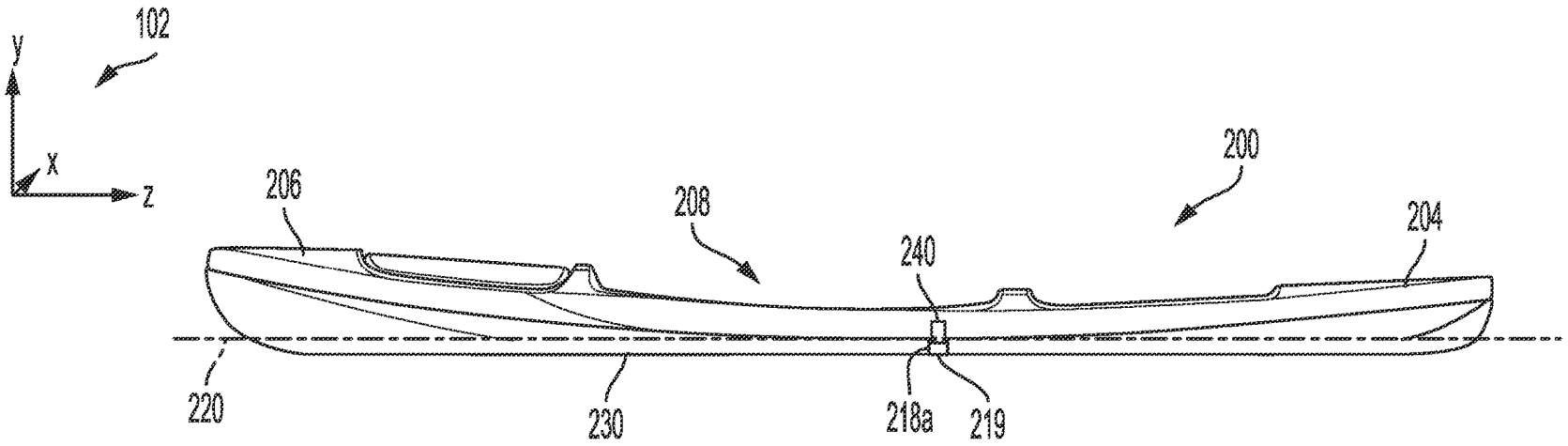
FIG. 2B shows a profile view of the sit-on-top kayak in water with the drainage valve system in a first position.
Figure 2C:
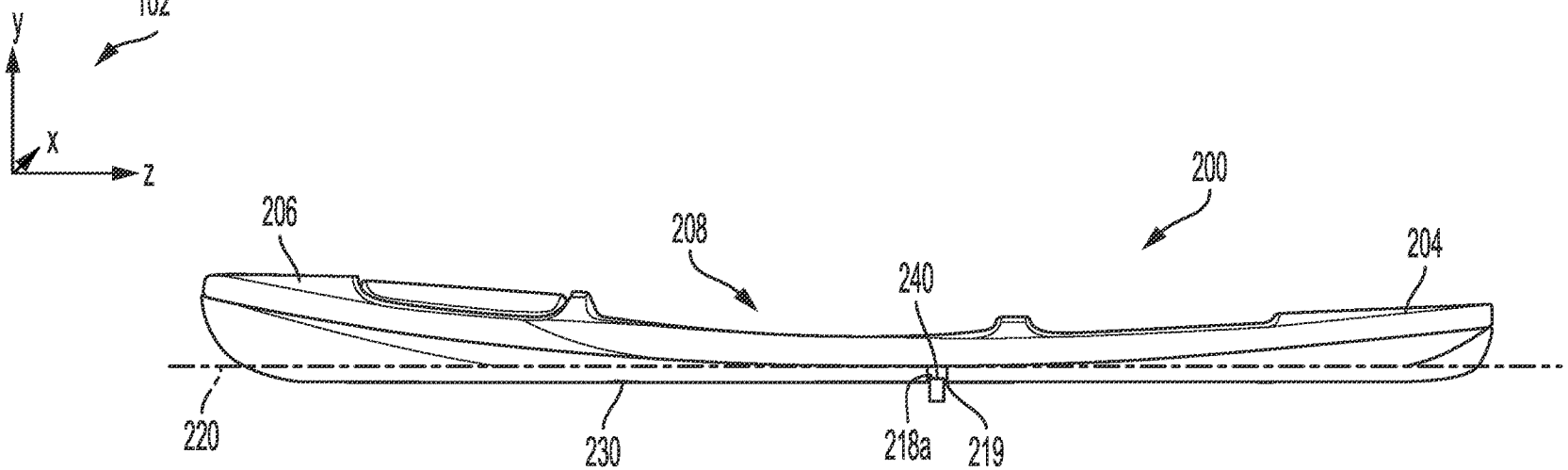
FIG. 2C shows a profile view of the kayak in water with the drainage valve system in a second position.

The bottom surface 148 of the outer frame 110 of the drainage valve system 100 is shown in FIG. 1D. The bottom surface 148 may be a solid circular plate, impervious to water flow, coupled to and arranged below the second outer portion 116 of the outer frame 110, with respect to the y-axis. An outer edge of the bottom surface 148 may extend outwards away from the central axis 101, forming the bottom lip 105 in the second outer portion 116 of the drainage valve system 100. As a result of the imperviousness of the bottom surface 148 to water flow, water flowing through the first inner chamber 118 and second inner chamber 120 of the drainage valve system 100 may not flow out of (or into) the drainage valve system 100, instead forced to exit (or enter) via the set of two apertures 138.

The drainage valve system 100 may be configured to be installed in a scupper of a recreational watercraft, such as a sit-on-top kayak, as shown in FIGS. 2B-2C. The scupper may include a fixed rubber gasket, such as an o-ring, installed within the scupper, the o-ring having an outer diameter equal to an inner diameter of the scupper and an inner diameter that may be wider than the outer diameter 125 of the body of the outer frame 110 but narrower than the outer diameter 121 of the outer frame 110 at the top lip 103 and the outer diameter 123 at the bottom lip 105. The o-ring may be unmovably fixed within the scupper. When arranged in the scupper with the o-ring encircling the body of the outer frame 110 between the top and bottom lips 103 and 105, a vertical movement, along the y-axis, of the drainage valve system 100 in the scupper may be stopped when moving upwards, e.g., when pulled upwards by pulling on the bar 128 or the string 134 wound through the apertures 132 in the top of the first outer portion 114 of outer frame 110, by contact between the o-ring and the bottom lip 105. When the drainage system is pushed downwards, e.g., by applying pressure to the top of the first outer portion 114 or the bar 128, the vertical motion is stopped by contact between the o-ring and the top lip 103.

An operation and effect of the drainage valve system on water flow may be explained in further detail in the following descriptions of FIGS. 2A-2C. An example of a sit-on-top kayak 200 is illustrated in FIGS. 2A-2C from a top-down view in FIG. 2A, and a side view in FIGS. 2B-2C, with a drainage valve system in a first position in FIG. 2B, and in a second position in FIG. 2C. A central axis 202 extends through a bow 204 and a stern 206 of the kayak 200, parallel with the x-axis. A central region of the kayak 200 may include a molded depression 208 with a seat section 210 and a set of foot beds 212, as shown in FIG. 2A. A set of indents 214 may be arranged, within the foot beds 212 at a first end 216 of the foot beds 212 closest to the seat section 210 as well as at a second end 203 of the foot beds 212, with scuppers 218 centered inside each indent of the set of indents 214. A drainage valve system, such as the drainage valve system 100 of FIGS. 1A-1E, may be positioned in one or more of the scuppers 218 and held in place by a fixed rubber gasket, such as the o-ring described above.

The side view of the sit-on-top kayak 200 depicted in FIGS. 2B-2C includes a water surface level, as indicated by a dashed line 220. Below the water surface level 220 in FIGS. 2B-2C, a cross-sectional view of the kayak 200 is shown for simplicity, taken along the y-z plane. The kayak 200 may have a bottom wall, or hull 230, of the kayak 200 and a scupper 218*a* of the scuppers 218 of FIG. 2A is shown in the cross-sectional view below the water surface level. The scupper 218*a* is shown in FIGS. 2B-2C as a vertical channel extending entirely through the hull 230 of the kayak 200 so that air (or fluid) inside the molded depression 208 is coupled to air (or fluid) external to the kayak 200 and surrounding the hull 230 of the kayak 200.

The scupper 218*a* may include a scupper outlet 219 at a bottom surface of the hull 230 that may be submerged below the water surface level, as indicated by the dashed line 220. A drainage valve system 240 may be arranged in the scupper 218*a* and positioned mostly above the water surface level 220 in a first position, as seen in FIG. 2B or mostly below the water surface level 220 in a second position, as seen in FIG. 2C. In one example, the drainage valve system 240 may be the drainage valve system 100 of FIGS. 1A-1E, positioned in the scupper 218*a* so that a central axis of the drainage system, e.g., the central axis 101 of the drainage valve system 100 of FIG. 1, is aligned with the y-axis.

The drainage valve system 240 may be adjusted by the user into the first position, the first position being a disengaged configuration, as shown in FIG. 2B, by pulling a string attached to the drainage valve system, e.g., the string 134 that is wound through the apertures 132 at the top of the first outer portion 114 of the outer frame 110 in FIG. 1, in an upwards direction, with respect to the y-axis. Alternatively, a user may apply an upwards pressure, e.g., pull, on a bar coupled to an upper portion of the drainage valve system 240, such as the bar 128 in FIGS. 1A and 1C. The upwards motion of the drainage valve system 240 through the scupper 218*a* may be halted by contact between a fixed o-ring in the scupper 218*a* and a bottom lip of an outer frame 110 of the drainage valve system 240. A bottom surface of the drainage valve system 240 may be a solid circular plate, such as the bottom surface 148 shown in FIG. 1D, fitting in a sealing manner within the scupper 218*a*. The drainage valve system 240 thereby acts as a plug when in the disengaged configuration, inhibiting water flow between an inside, e.g., the molded depression 208, and an outside, e.g. water surrounding the hull 230, of the kayak 200 through the scupper 218*a*.

When adjusted into the first position of FIG. 2B, the bottom surface of the drainage valve system 240 may be below or at the water surface level 220 and in contact with water. Most of the drainage valve system 240 may be above the water surface level 220 and not in contact with water surrounding the kayak 200 so that an upper region of the drainage valve system 240 is closer to a user seated in the molded depression 208, along the y-axis, than when the drainage valve system 240 is in the second position of FIG. 2C. The drainage valve system 240 may protrude upwards from a surface of the molded depression or alternatively a top of the drainage valve system 240 may be flush with the surface of the molded depression, depending on a thickness of the hull 230.

In FIG. 2C, the drainage valve system 240 may be positioned in the second position, in an engaged configuration, by applying pressure downwards, e.g., pushing down, along the y-axis, to the top of the outer frame of the drainage valve system 240 or to the bar, coupled to the upper region of the drainage valve system 240. A downwards shift of the drainage valve system 240 within the scupper 218*a* may be stopped by contact between the fixed o-ring in the scupper and a top lip of the drainage valve system 240, as shown in FIG. 2C. All or at least a large portion of the drainage valve system 240, below the top lip, is submerged below the water surface level, indicated by dashed line 220, including an inner ball valve, such as the inner ball valve 112 shown in FIGS. 1A-1C and FIG. 3, disposed within an inner chamber of the drainage valve system 240.

The drainage valve system 240 may be oriented in FIGS. 2B-2C so that a pair of apertures, such as the set of two apertures 138 shown in FIGS. 1A-1B, in the outer frame of the drainage valve system 240, which are also exit ports, are facing towards the stern 206 of the sit-on-top kayak 200. The bar, e.g., the bar 128 of FIGS. 1A and 1C, coupled to the upper portion of the drainage valve system 240 and aligned parallel with the x-axis, may be adjusted to be perpendicular to the central axis 202, shown in FIG. 2A, of the kayak 200. As a result of aligning the bar perpendicular to the central axis 202, the drainage valve system 240 may be positioned in the scupper 218*a* so that the exit ports face the stern 206 of the kayak 200. As such, the bar may be used to confirm that the drainage valve system 240 is oriented so that the exits ports are facing the stern 206. The user may use the bar to turn the drainage valve system 240 in the scupper 218*a* so that the exit ports face the stern 206 of the kayak 200 when the drainage valve system 100 is pushed down into the second position shown in FIG. 2C. In the second, engaged, position, the exit ports, which may be fluid outlets for the drainage valve system 240, may be submerged below the water surface level 220 while facing the stern 206 of the kayak 200.

By arranging the scupper 218*a* in a region of the molded depression 208 where water is most likely to collect, such as the foot beds 212 shown in FIG. 2A, the adjustment of the drainage valve system 240 in the second position allows the water in the foot beds to be fluidly coupled to water surrounding the kayak 200. Thus water may flow from the molded depression 208 into the scupper 218*a*, through the drainage valve system 240 below the water surface level 220 and out through the exit ports facing the stern 206 of the kayak 200. The flow of water may be motivated by formation of a low pressure region external and adjacent to the drainage valve system 240 that is fluidly communicated to the water in the foot beds of the molded depression. A pressure differential between the low pressure region and the water in the foot beds induces flow, as described below with reference to FIGS. 3 and 4.

Figure 3:
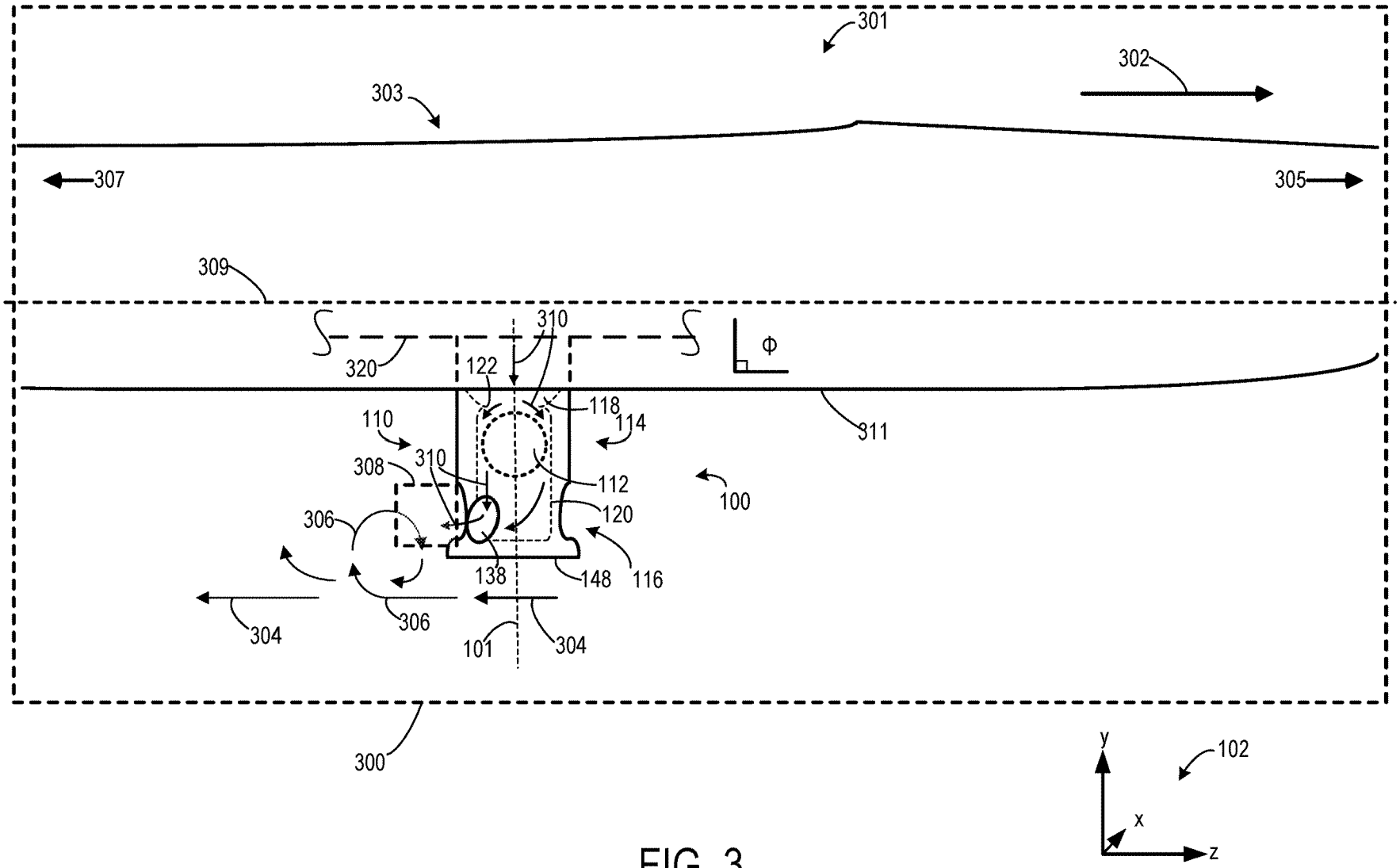
FIG. 3 shows an expanded profile view of the drainage valve system in an engaged configuration.
Figure 4:
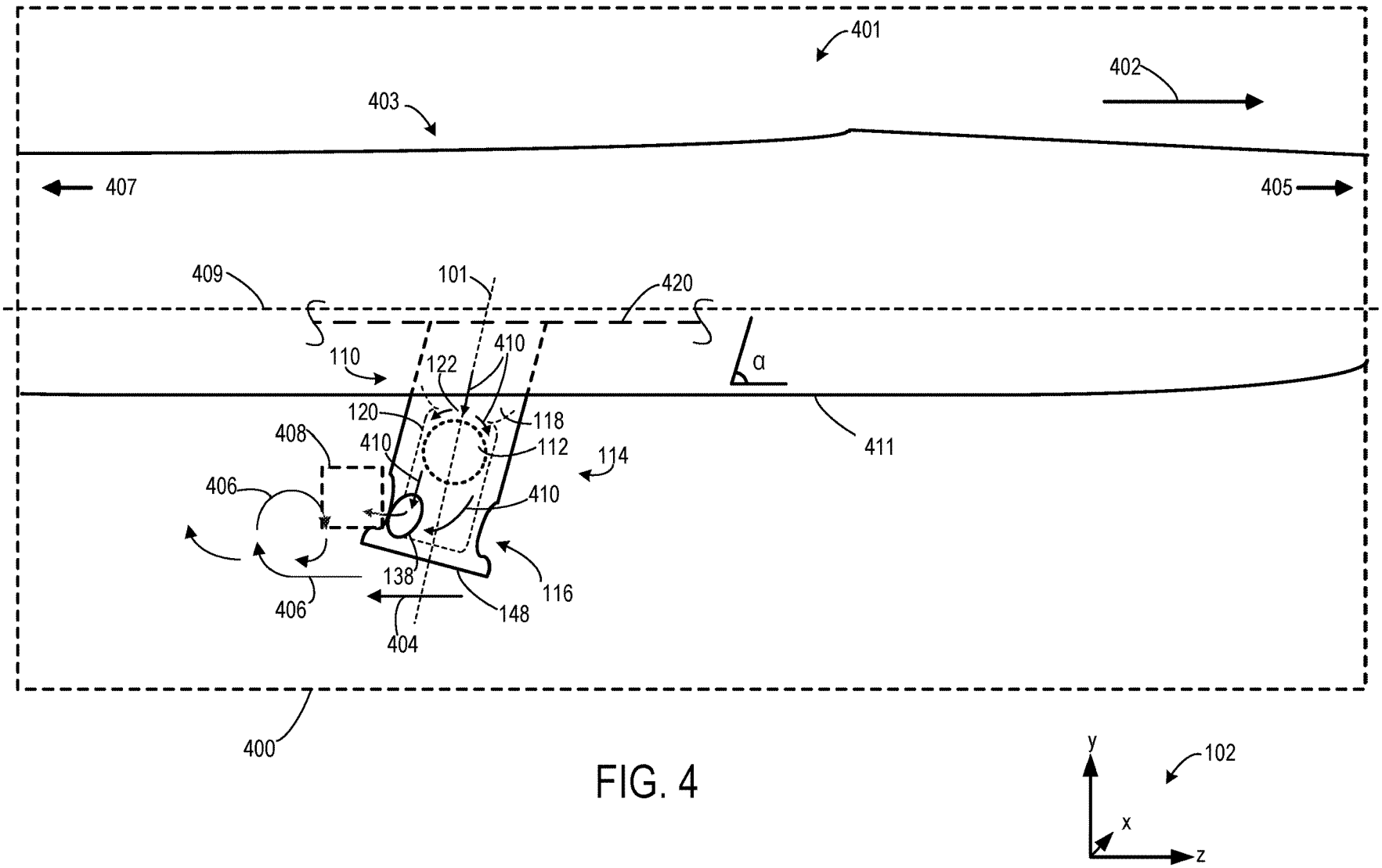
FIG. 4 shows an expanded profile view of an alternate arrangement of the drainage valve system in the engaged position.

A positioning of a drainage valve system in a scupper of a kayak may be viewed in greater detail in FIG. 3. An expanded view 300 of a portion of a kayak 301, which, in some examples, may be the kayak 200 of FIGS. 2A-2C, is shown from a side of the kayak 301. The kayak 301 has a molded depression 303 in which a user may be seated. A bow of the kayak 301 is indicated by arrow 305 and a stern of the kayak 301 is indicated by arrow 307. The kayak 301 may be partially submerged below a water line, indicated by dashed line 309.

The kayak 301 may have a plurality of scuppers, such as the scuppers 218 of FIG. 2A. Each scupper of the plurality of scuppers may extend entirely though a hull 311 of the kayak 301, fluidly coupling air or water inside the molded depression 303 to water surrounding the hull 311 and external to the kayak 301. The molded depression 303 may include foot beds and indents, with reference to the foot beds 212 and indents 214 shown in FIG. 2A that are at or below the water line 309. The plurality of scuppers may be positioned in the indents of the foot beds so that the plurality of scuppers are consistently at or below the water line 309 when the kayak 301 is placed in a body of water.

A scupper outlet 320 is shown in FIG. 3, arranged in the hull 311 of the kayak 301 below the water line 309. In one example, as shown in FIG. 3, the drainage valve system 100 of FIGS. 1A-1E may be installed in one or more of the plurality of scuppers of the kayak 301. The drainage valve system 100 is depicted in FIG. 3 in a second, engaged, position, as described above with reference to FIG. 2C, so that a portion of the drainage valve system 100 extends downwards, with respect to the y-axis, from the scupper outlet 320, underwater.

A scupper, which includes the scupper outlet 320, in which the drainage valve system 100 may be a channel extending linearly through the hull 311 of the kayak 301, parallel with the y-axis. An alignment of the scupper results in an alignment of the drainage valve system 100 so that the central axis 101 of the drainage valve system 100 is also parallel with the y-axis. The drainage valve system 100 may be adjusted, using the bar at the top of the outer frame 110 of the drainage valve system 100, so that the set of two apertures 138, e.g., the exit ports, are facing the stern 307 of the kayak 301.

In the second position shown in FIGS. 2C and 3, the drainage valve system 100 may compel flow of water from the molded depression 303 of the kayak 301, through the scupper and drainage valve system 100 and out through the apertures 138 of the drainage valve system 100. For example, a user may propel, e.g., paddle, the kayak 301 forward so that the kayak 301 is travelling in a direction indicated by arrow 302. Water may flow past the drainage valve system 100 in a direction shown by arrows 304. The laminar flow passing the drainage valve system 100 may experience turbulence due to the protrusion of the drainage valve system 100 into the path of flow indicated by arrow 304, resulting in a generation of turbulent eddies, indicated by arrows 306. The turbulent eddies may swirl in a clockwise direction in a region downstream of the drainage valve system 100 on a side of the drainage valve system 100 facing the stern of the kayak 301, e.g., behind the drainage valve system 100. The turbulent swirling downstream of the drainage valve system 100 may create a region of low pressure, indicated by a square 308, that is adjacent to the set of two apertures 138 of the drainage valve system 100. The formation of the low pressure region 308 may induce an aspirating or a suction effect, drawing water through the drainage valve system 100. A flow of water through the drainage valve system 100 may be assisted by a mobility of the inner ball valve 112 of drainage the valve system 100 within the second inner chamber 120 of the outer frame 110 of the drainage valve system 100.

As described above, the inner ball valve 112 may be a hollow sphere filled with air. When the drainage valve system 100 is adjusted to the second position, the inner ball valve 112 may be fully submerged below the water surface level 309 and may float up, with respect to the y-axis, towards the water surface level due to a difference in density between air and water. Upwards movement of the inner ball valve 112 may be halted by the inner opening 122 of the drainage valve system 100, which has a smaller diameter, the diameter measured perpendicular to the central axis 101, than the diameter of the inner ball valve 112, thus confining the inner ball valve 112 to the second inner chamber 120 of the drainage valve system 100. The inner ball valve 112 may press upwards against the inner opening 122 when submerged underwater. The positioning of the inner ball valve 112 against the inner opening 122 may provide a barrier to the flow of water from outside of the drainage valve system 100 into the molded depression 303 of the kayak 301 through the drainage valve system 100 when the kayak 301 is not in motion and the drainage valve system 100 is in the second position. The upwards displacement of the inner ball valve 112 may also move the inner ball valve 112 away from the set of two apertures 138 so that the flow exiting the drainage valve system 100 through the set of two apertures 138 may not be hindered by the inner ball valve 112.

Water accumulated above the drainage valve system 100 and pooled in the molded depression 303 of the kayak 301, is fluidly coupled to the water surrounding the submerged drainage valve system 100 via the drainage valve system 100. Upon formation of the low pressure region 308 as the kayak 301 is propelled forwards as indicated by arrow 302, a pressure differential between the water above the drainage valve system 100 and the low pressure region 308, may aspirate water from the molded depression 303, through the scupper, and into the first inner chamber 118 of the drainage valve system 100. A path of water flow is indicated by arrows 310. The flow through the scupper may exert a force on the buoyant inner ball valve 112, pushing the inner ball valve 112 downwards enough to allow water to flow past the inner ball valve 112, into the second inner chamber 120 and out of the drainage valve system 100 via the set of two apertures 138. During events where the forward propulsion of the kayak 200 may be slowed or halted, a pressing of the inner ball valve 112 against the inner opening 122, resulting from the buoyancy of the submerged inner ball valve 112, may inhibit a reverse flow of water from outside of the kayak 301 into the molded depression 303 through the drainage valve system 100.

Upon reaching a desired level of drainage of water from the molded depression 208 of the kayak 200, the user may adjust the drainage valve system 100 into the first, disengaged position. In the first position, the drainage valve system 100 is fully retracted into the scupper. A diameter of the drainage valve system 100 may be configured to match an inner diameter of the scupper so that a width of the scupper, the width perpendicular to the central axis 101, is entirely filled by the drainage valve system 100. For example, the bottom surface 148 of the drainage valve system 100 may seal the scupper. The set of two apertures 138 of the drainage valve system 100 are blocked by an inner wall of the scupper, no longer in fluid communication with water in the molded depression 303 of the kayak 301 or with water surrounding the hull 311.

In FIG. 3, the scupper and the drainage valve system 100 of FIG. 3 may be aligned perpendicular to a bottom surface of the hull 311, as indicated by an angle Φ. However, other examples may include variations in an angling of the scupper and drainage valve system relative to the bottom surface of the hull 311. As one example, as shown in an expanded view 400 in FIG. 4, a kayak 401 may have an alternate orientation of a scupper and a drainage valve system. The kayak 401 may be similar to the kayak 301 of FIG. 3, with a molded depression 403, a bow indicated by arrow 405, a stern indicated by arrow 407, and a scupper extending through a hull 411 and coupled to a scupper outlet 420. A water line is indicated by dashed line 409.

The drainage valve system 100 of FIG. 1 may also be installed in the scupper of the kayak 401, shown adjusted to the second position in FIG. 4 and oriented so that the set of two apertures 138 face the stern of the kayak 401. The scupper of the kayak 401 may not be aligned perpendicular to a bottom surface of the hull 411, as shown by the angle Φ in FIG. 3. Instead, the scupper may be tilted relative to the y-axis so that the scupper forms an angle α that is less than 90 degrees relative to the bottom surface of the hull 411. The tilting of the scupper may result in an inlet of the scupper, disposed in the molding depression 403 of the kayak 401 to be closer to the bow, indicated by arrow 405, than the scupper outlet 420.

The tilting of the scupper may also result in a similar tilting of the drainage valve system 100 so that the central axis 101 of the drainage valve system 100 is also angled relative to the bottom surface of the hull 411 by the angle α. As an example, the angle α may be an angle between 45 and 90 degrees. Tilting the drainage valve system 100 to an angle less than 45 degrees, e.g., α is less than 45 degrees, may degrade an efficiency of the drainage valve system 100 to remove water from the molded depression 403 of the kayak 401.

The drainage valve system 100 may drain water from the molded depression 403 of the kayak 401 in a similar manner as in the kayak 301 of FIG. 3, as described above. As the kayak 401 is propelled forwards, as indicated by arrow 402, water flows past the drainage valve system 100 as indicated by arrow 404. A protrusion of the drainage valve system 100 into the water flowing past may generate turbulent swirling of the flow, as indicated by arrows 406. A region of low pressure 408 forms behind the drainage valve system 100, adjacent to the set of two apertures 138. A pressure differential between water in the molded depression 403 of the kayak 401 and the low pressure region 408, fluidly coupled by the drainage valve system 100, aspirates water from the molded depression 403 to the low pressure region 408. Water flows past the inner ball valve 112, as indicated by arrows 410, and out through the set of two apertures 138.

By tilting the drainage valve system 100 so that angle α is between 45-90 degrees, faster flow of water through the drainage valve system may be encouraged. In one example, drainage speed may be further enhanced by increasing a diameter of the scupper and the diameter of the drainage valve system 100, the diameters of both the scupper and the drainage valve system 100 perpendicular to the central axis 101.

For example, a first drainage valve system may comprise a ball valve with a 1 inch diameter and may be aligned in a first scupper at a 90 degree angle relative to a bottom surface of a hull of a first kayak. A first scupper of the first kayak, and an outer housing of the first drainage valve system may have dimensions adapted to accommodate the diameter of the 1 inch ball valve.

A second drainage valve system of a second kayak, positioned in a second scupper aligned at 60 degrees relative to a bottom surface of a hull of the second kayak, may also be aligned at 60 degrees relative to the bottom surface of the hull of the second kayak. The angle of the second drainage valve system may increase a rate of water flow through the second drainage valve system by twofold compared to the first drainage system. The second drainage valve system may additionally be configured with a second ball valve with a 1.5 inch diameter. A diameter of the second scupper and of an outer housing of the second drainage valve system may be proportionally wider than the diameters of the first scupper and the outer housing of the first drainage valve system, to accommodate the larger second ball valve. As a result water may drain through the second drainage valve system at a rate that is, for example, threefold faster compared to the first drainage valve system. An efficiency of drainage may thereby be adjusted by altering an angle and dimensions of a drainage valve system, such as the drainage valve system 100 of FIGS. 1A-1E, 3, and 4 and drainage valve system 240 of FIGS. 2A-2C.

Figure 5:
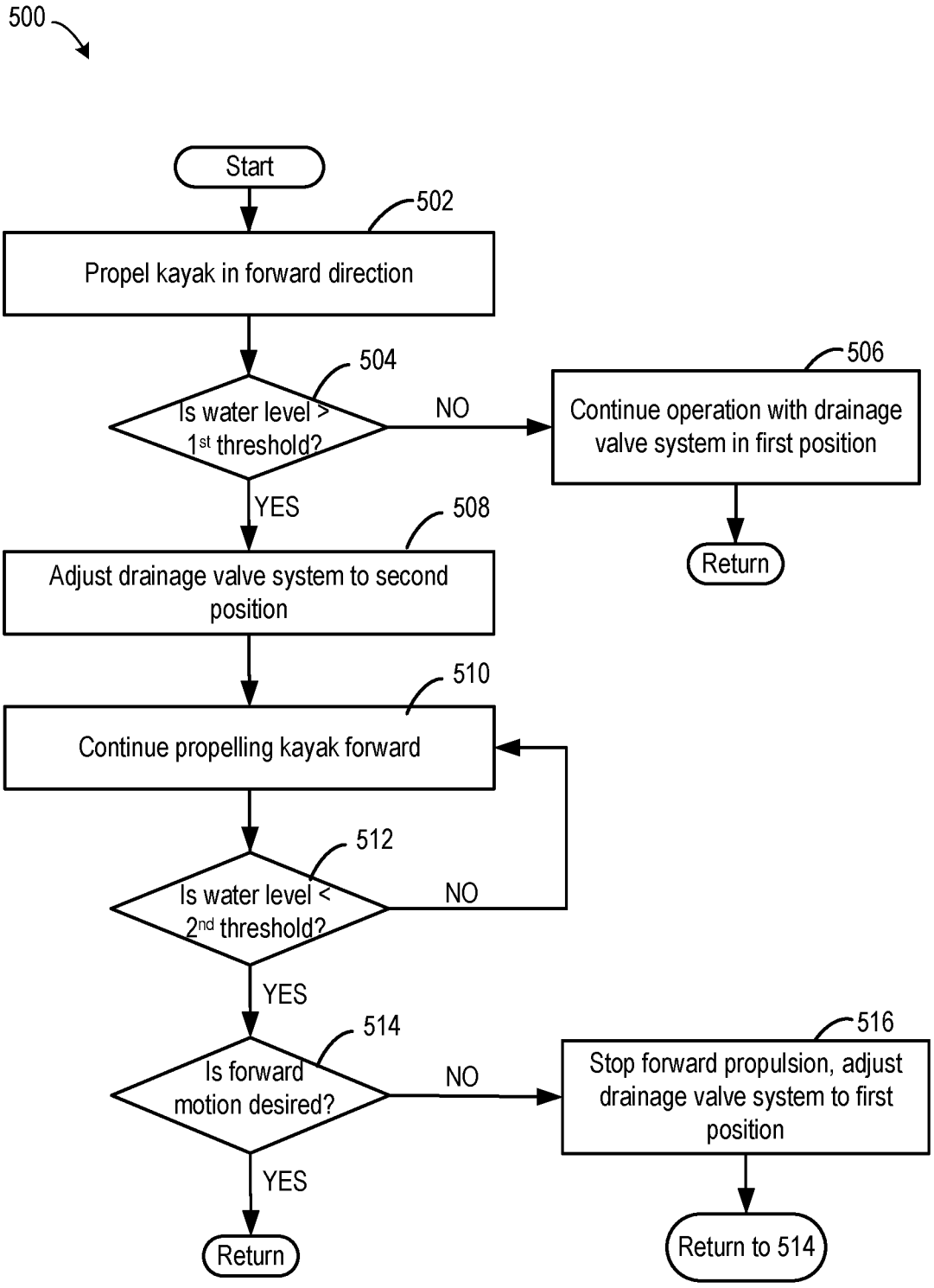
FIG. 5 shows a method for draining water from an interior of a watercraft through the drainage valve system.

A method for 500 draining water from a seating area of a sit-on-top kayak is shown in FIG. 5. The sit-on-top kayak, or kayak, may be the kayak 200 of FIGS. 2A-2C, 301 of FIG. 3 or 401 of FIG. 4. A hull of the kayak may include one or more scuppers, extending entirely through a thickness of the hull and fluidly coupling air or water in the seating area to air or water surrounding the hull of the kayak. At least two scuppers may be disposed in foot beds of the seating area of the kayak, consistently below a water line of the kayak when the kayak is at least partially submerged in a body of water. A drainage valve system, such as the drainage valve system 100 of FIGS. 1A-1E, 3, and 4, may be installed in each of the scuppers, adjustable between a first position, where the drainage valve system is fully retracted into the scuppers, and a second position, where the drainage valve system is pushed downwards so that a portion of the drainage valve system extends downwards from the hull of the kayak, protruding into water surrounding the hull. The drainage valve system has an inner ball valve, confined within an inner chamber of the drainage valve system, as well as apertures, oriented to face a stern of the kayak through which water may exit the drainage valve system. Method 500 may be executable by an operator of the kayak, positioned in the seating area of the kayak.

At 502, the method includes propelling the kayak in a forwards direction. Initially, the drainage valve system may be in the first, disengaged position. The operator may drive forwards movement of the kayak by paddling with a paddle or oar. The operator may determine, at 504, whether a water level in the seating area of the kayak is at or above a first threshold. Water may collect in the seating area due to spraying of water during paddling or as a result of turbulent conditions that drives splashing of water into the seating area. In one example, the first threshold may be a level of water that imparts discomfort to the user by at least partially submerging the user in water beyond a tolerance of the user. As another example, the first threshold may be a level of water accumulation in the seating area that adds to a weight of the kayak, imposing difficulty in continued forward motion of the kayak as manually propelled by the user.

If the water level is determined to not reach the threshold, the method proceeds to 506 to continue paddling the kayak to induce forward motion of the kayak with the drainage valve in the first position. The method then returns to the start.

If the water level is determined to reach or surpass the first threshold, the method continues to 508 to adjust the drainage valve system to the second position. The drainage valve system may be shifted to the second position by the operator applying a downwards force to a top of the drainage valve system until the downwards motion of the drainage valve system is halted by contact between an upper lip of the drainage valve system and a gasket or an o-ring positioned in the scupper proximate to an outlet of the scupper.

At 510 of the method, forward propulsion of the kayak is continued. The protrusion of the drainage valve system in the water flowing past the drainage valve system, in a direction from the bow of the kayak to the stern, creates a low pressure region behind the drainage valve system, adjacent to the apertures facing the stern. A difference in pressure between the flooded seating area and the low pressure region, fluidly coupled through the scupper and drainage valve system, aspirates the water from the seating area to the low pressure region, thereby draining water from the seating area.

The operator may determine, at 512, whether the water level in the seating area falls below a second threshold. In one example, the second threshold may be equal to the first threshold. In another example, the second threshold may be a level of water that is lower than the first threshold. For example, the second threshold may be an amount of water in the seating area that allows a desirable decrease in energy expended by the operator to continue paddling the kayak forwards, relative to when water is collected in the seating area. Alternatively, the second threshold may be a minimal amount of water remaining in the seating area, e.g., the seating area is nearly emptied of water. In another example, the second threshold may be low enough level of water in the seating area that the user's feet are no longer submerged in water.

If the water level is determine to not yet fall below the second threshold, the method returns to 510 to continue propelling the kayak forward with the drainage valve in the second position to resume draining water from the seating area. If the water level is determined to fall below the second threshold, the method continues to 514 to determine whether forward of the kayak is still desired. The operator may, for example, choose to continue paddling the kayak to reach a target destination or achieve a target amount of exercise. In another example, the operator may choose to stop paddling to rest or observe surrounding scenery. In yet another example, the operator may wish to reverse the direction of motion of the kayak, e.g., the operator may paddle so the kayak moves backwards.

If forward motion is not desired, the method proceeds to 516. The operator may halt forward propulsion by terminating paddling or by paddling with a reverse stroke. The drainage valve system may be adjusted to the first position to ensure that bobbing of the kayak does not cause sufficient vertical motion of the inner ball valve of the drainage valve system to allow water to flow into the seating area through the scupper. The drainage valve system may be adjusted to the first positon by pulling upwards on a bar attached to an upper portion of the drainage valve system or a string looped through apertures in the upper portion of the drainage valve system. Pulling the drainage valve system upwards shifts the drainage valve system up into the scupper so that the drainage valve system does not protrude from the hull of the kayak. Furthermore, a bottom surface of the drainage valve system may seal the scupper.

If forward motion of the kayak is desired at 514, however, the method returns to the start. The drainage valve system may remain in the second position to allow immediate drainage of any water collected in the seating area or the user may adjust the drainage valve system to the first position if drainage is not demanded. Retracting the drainage valve system to the first position may be desirable during high speed propulsion of the kayak to minimize drag generated by structures protruding from the hull of the kayak.

In this way, a drainage valve system may be adjustable to act either as a plug or a drainage device by varying a vertical position of the drainage valve system within a scupper. In one example, when water enters the interior of the kayak, accumulating in the molded depression in which a user may be seated, the user may initiate drainage of the kayak by propelling the kayak forward with the drainage valve system in a first, extended, and engaged configuration. The forward motion of the kayak and flow of water past the drainage valve system may result in the generation of a low pressure region downstream of the drainage valve system and adjacent to exit ports in a lower region of the drainage valve system. The pressure differential may induce flow of water through the drainage valve system from the interior of the kayak to the low pressure region, with flow emerging through the exit ports, thereby mitigating the pooling of water within the kayak interior. In another example, when flow through the drain valve system is not desired, the user may adjust the drainage valve system to a second, less extended, and disengaged configuration, thus blocking flow through the scupper. The technical effect of the drainage valve system is that the pressure differential created by turbulent flow downstream of the drainage valve system is leveraged to induce flow through the drainage valve system, the flow removing water accumulated within the kayak interior.

FIGS. 1A-4 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. As well, elements may be described in the direction of water flow and any element in the path of water flow relative to a reference point is considered downstream of the reference point. Conversely, any element positioned in the reverse direction of water flow relative to a reference point is upstream of the reference point.

It will be appreciated that the configurations and routines disclosed herein are exemplary in nature, and that these specific embodiments are not to be considered in a limiting sense, because numerous variations are possible. For example, the above technology can be applied to traditional kayaks, canoes, rowboats, and other watercraft types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A drainage valve system comprising:

an outer frame configured to;

slide upwards vertically to retract within a scupper of the watercraft in a first position, the first position a closed position blocking flow of water through the scupper;

slide downwards vertically to protrude from the scupper in a second position, the second position a position open to flow of the water through the scupper; and an inner ball valve that is a buoyant sphere adapted to fit moveably within a portion of the outer frame.

2. The drainage valve system of claim 1, wherein the outer frame has a circular cross-section, the cross-section perpendicular to a central axis of the drainage valve system, including a first inner chamber stacked vertically on top of a second inner chamber and wherein the inner ball valve is enclosed within the second inner chamber.

3. The drainage valve system of claim 2, wherein a merging region between the first inner chamber and the second inner chamber has a narrower diameter, the diameter perpendicular to the central axis, than either the first inner chamber or the second inner chamber.

4. The drainage valve system of claim 3, wherein the inner ball valve has a wider diameter than the diameter of the merging region.

5. The drainage valve system of claim 4, wherein the inner ball valve is positioned at the bottom of the second inner chamber when the drainage valve system is adjusted to the first position and wherein the inner ball valve moves upwards and presses against the merging region when the drainage valve system is adjusted to the second position.

6. The drainage valve system of claim 3, wherein the outer frame includes a first portion and a second portion, the first portion having a cylindrical shape and surrounding the first inner chamber and a portion of the second inner chamber and the second portion have walls curving inwards, towards the central axis, and surrounding a remaining portion of the second inner chamber.

7. The drainage valve system of claim 6, wherein the second portion of the outer frame has exit ports that are through-holes through the walls of the second portion and wherein the exit ports are disposed on a first half of the second portion of the outer frame as delineated by a dissecting plane that is parallel with the central axis and divides a circumference of the second outer portion into two equal halves.

8. The drainage valve system of claim 7, wherein the first portion of the outer frame includes a bar arranged substantially along a horizontal plane with ends of the bar adapted to fit into grooves positioned in an upper region of the first portion of the upper frame and wherein the bar is aligned parallel with the dissecting plane and perpendicular to a length, running from a bow to a stern, of the watercraft.

9. The drainage valve system of claim 8, wherein the arrangement of the bar to be perpendicular to the length of the watercraft arranges the exit ports of the second portion of the outer frame to face the stern.

10. The drainage valve system of claim 9, wherein the first portion of the outer frame includes a plurality of apertures through which a string is wound and a plurality of ridges arranged circumferentially around an outer surface of the first portion.

11. The drainage valve system of claim 1, wherein a top of the outer frame has an opening and a bottom of the outer frame has a solid surface.

12. The drainage valve system of claim 1, wherein the outer frame, when arranged in the first position, is entirely retracted into the scupper of the water craft and blocking flow through the scupper.

13. The drainage valve system of claim 1, wherein the outer frame, when arranged in the second position, is submerged below a water surface level and protrudes from a hull of the watercraft.

14. A method for draining water from an interior of a watercraft, comprising;

moving the watercraft through water with a drainage valve system in a first, extended position, water flowing past at least part of an extended exit port of the drainage valve system creating suction to draw water through the drainage valve system; and adjusting the drainage valve system into a second, less extended position in which the drainage valve system is fully closed between the exit port and the interior of the watercraft.

15. The method of claim 14, wherein moving the watercraft through water with the drainage valve system in the first, extended position includes moving the watercraft in a forward direction with the exit port of the drainage valve system facing a rear of the watercraft.

16. The method of claim 15, wherein creating suction as water flows past the exit port includes generating a low pressure region adjacent to the exit port and behind the exit port relative to the forward direction of motion of the watercraft.

17. The method of claim 16, wherein generating the low pressure region compels water flow from the interior of the watercraft, through the drainage valve system and out through the exit ports.

18. The method of claim 14, wherein adjusting the drainage valve system into the second, less extended position includes pulling the drainage valve system upwards through a drainage channel in a hull of the watercraft.

19. A watercraft, comprising:

a wall with a movable valve element positioned therein, the valve having an exit port forming channels that, when extended from the wall, create suction with the watercraft moving through the water, the valve positionable in a less-extended closed position.

20. The watercraft of claim 19, wherein the valve has an upper lip and a lower lip and movement of the valve between the more extended and less extended positions is halted by contact between the upper and lower lips and a gasket arranged in an opening in the wall in which the valve is disposed.

* * * * *